US009038836B1

(12) United States Patent
Tavares et al.

(10) Patent No.: US 9,038,836 B1
(45) Date of Patent: May 26, 2015

(54) LIGHTWEIGHT COUPLER

(71) Applicant: Pennsy Corporation, West Chester, PA (US)

(72) Inventors: Manuel Tavares, Doylestown, PA (US); Michael J. Schmidt, Norristown, PA (US)

(73) Assignee: PENNSY CORPORATION, West Chester, PA (US)

( * ) Notice: Subject to any disclaimer, the term of this patent is extended or adjusted under 35 U.S.C. 154(b) by 21 days.

(21) Appl. No.: 13/678,203

(22) Filed: Nov. 15, 2012

(51) Int. Cl.
*B61G 3/00* (2006.01)
*B61G 3/04* (2006.01)

(52) U.S. Cl.
CPC ..... *B61G 3/04* (2013.01)

(58) Field of Classification Search
CPC ..... B61G 9/24; B61G 9/06; B61G 9/18; B61G 9/14; B61G 9/00; B61G 9/22; B61G 7/10; B61G 11/08; B61G 3/04
See application file for complete search history.

(56) References Cited

U.S. PATENT DOCUMENTS

| | | | |
|---|---|---|---|
| 461,312 | A | 10/1891 | Brown |
| 533,985 | A | 2/1895 | Brown |
| 693,998 | A | 2/1902 | Brown |
| 1,382,530 | A | 6/1921 | Murphy |
| 1,966,765 | A | 7/1934 | Murphy |
| 2,088,135 | A | 7/1937 | Johnson et al. |
| 2,562,504 | A | 7/1951 | Metzger |
| 2,689,051 | A | 9/1954 | Kayler |
| 3,604,569 | A | 9/1971 | Kulieke |
| 3,635,356 | A | 1/1972 | Shramovich |
| 3,640,402 | A | 2/1972 | Altherr et al. |
| 3,670,901 | A | 6/1972 | Metzger |
| 3,722,708 | A | 3/1973 | Ion et al. |
| 3,735,877 | A | 5/1973 | Bossong |

(Continued)

FOREIGN PATENT DOCUMENTS

EP 1060971 A1 12/2000

OTHER PUBLICATIONS

Brandenberg, Kristin; "Successfully Machining Austempered Ductile Iron (ADI)"; Applied Process Inc. Technologies Div.—Livonia, Michigan, USA; Oct. 2001.

(Continued)

*Primary Examiner* — Jason C Smith
(74) *Attorney, Agent, or Firm* — John F. A. Earley, III; Frank J. Bonini, Jr.; Harding, Earley, Follmer & Frailey, P.C.

(57) ABSTRACT

The coupler system of a railway car truck is constructed such that basic overall appearance may be maintained, but the actual material of which it is constructed is changed. According to one embodiment, the coupler is constructed from cast austempered ductile iron; whereas cast iron has a density, 0.26 lbs/in^3, which is approximately 8% less than steel, 0.283 lbs/in^3, thereby allowing for a reduction in weight over steel. A suitable austempering process is used to produce the austempered metal coupler and components thereof. A second benefit of embodiments of the present invention provides for a more efficient use of materials, meaning less metal is used to make the same final shape, as a way of reducing the coupler weight. Both factures combined allow for a lighter weight coupler, while utilizing the standard designs. Alternate coupler configurations are disclosed for further reducing coupler weight.

32 Claims, 4 Drawing Sheets

(56) References Cited

U.S. PATENT DOCUMENTS

| | | | | | |
|---|---|---|---|---|---|
| 3,779,397 | A | | 12/1973 | De Penti | |
| 3,854,599 | A | | 12/1974 | Day et al. | |
| 3,856,156 | A | | 12/1974 | Metzger | |
| 3,858,729 | A | | 1/1975 | Altherr | |
| 4,024,958 | A | | 5/1977 | Kaufhold | |
| 4,051,954 | A | | 10/1977 | Roberts | |
| 4,081,082 | A | | 3/1978 | Scherrer et al. | |
| 4,090,615 | A | | 5/1978 | Martin | |
| 4,206,849 | A | | 6/1980 | Kaim | |
| 4,537,304 | A | | 8/1985 | Kaim et al. | |
| 4,591,059 | A | * | 5/1986 | Hammarlund | 213/32 R |
| 4,605,133 | A | | 8/1986 | Altherr | |
| 4,645,085 | A | | 2/1987 | Hanula et al. | |
| 4,984,696 | A | | 1/1991 | Altherr | |
| 5,096,076 | A | | 3/1992 | Elliott et al. | |
| 5,320,229 | A | | 6/1994 | Mautino et al. | |
| 5,511,676 | A | | 4/1996 | Holmes | |
| 5,582,307 | A | * | 12/1996 | Hawthorne et al. | 213/109 |
| 5,878,897 | A | * | 3/1999 | Lazzaro et al. | 213/139 |
| 5,900,082 | A | | 5/1999 | Hewitt | |
| 5,954,212 | A | | 9/1999 | Beatty et al. | |
| 6,129,227 | A | * | 10/2000 | Openchowski et al. | 213/111 |
| 6,148,733 | A | | 11/2000 | Gagliardino | |
| 6,155,442 | A | * | 12/2000 | Wurzer et al. | 213/62 R |
| 6,796,448 | B1 | * | 9/2004 | Wilt et al. | 213/40 R |
| 7,302,994 | B2 | | 12/2007 | Mautino et al. | |
| 7,337,826 | B2 | | 3/2008 | Mautino et al. | |
| 7,757,871 | B2 | | 7/2010 | Mautino et al. | |
| 8,056,741 | B2 | | 11/2011 | Mautino et al. | |
| 8,196,762 | B2 | | 6/2012 | Smerecky | |
| 8,201,613 | B2 | | 6/2012 | Marchese et al. | |
| 8,220,175 | B2 | | 7/2012 | Saeler | |
| 8,297,455 | B2 | * | 10/2012 | Smyth | 213/155 |
| 8,381,923 | B2 | * | 2/2013 | Smyth | 213/155 |
| 8,408,406 | B2 | * | 4/2013 | Smerecky et al. | 213/75 R |
| 8,485,371 | B2 | | 7/2013 | Nibouar et al. | |
| 8,544,662 | B2 | * | 10/2013 | Smerecky et al. | 213/75 R |
| 2004/0173555 | A1 | * | 9/2004 | Wilt et al. | 213/50 |
| 2008/0128377 | A1 | * | 6/2008 | Mautino et al. | 213/75 R |
| 2009/0289022 | A1 | | 11/2009 | Smerecky et al. | |
| 2009/0289024 | A1 | | 11/2009 | Nibouar et al. | |
| 2010/0326943 | A1 | | 12/2010 | Mautino et al. | |
| 2011/0024379 | A1 | * | 2/2011 | Ely | 213/67 R |
| 2011/0068077 | A1 | * | 3/2011 | Smyth | 213/155 |
| 2011/0163059 | A1 | | 7/2011 | Gagliardino et al. | |
| 2011/0168655 | A1 | * | 7/2011 | Nibouar et al. | 213/100 R |
| 2012/0292279 | A1 | * | 11/2012 | Wilt et al. | 213/22 |
| 2013/0042785 | A1 | * | 2/2013 | Schmidt et al. | 104/262 |
| 2013/0160962 | A1 | | 6/2013 | Nibouar et al. | |
| 2013/0206716 | A1 | | 8/2013 | Burgoyne et al. | |
| 2014/0076193 | A1 | * | 3/2014 | Brook et al. | 104/262 |

OTHER PUBLICATIONS

A. Kahn and B.K. Chen, "Evaluation of Grade 1 Austempered Ductile Iron for Application to Rail Cast Components", Proceedings of the Fifth Asia Pacific Industrial Engineering a.

Luis Magalhães, Jorge Seabra, "Teeth Surface Failures in Austempered Ductile Iron (ADI) Gears", Gears and Transmission Workshop, Paper No. XIII, p. 269-286, Faculdade de Engen.

Stokes B. et al.; "Effects of Carbides on Fatigue Characteristics of Austempered Ductile Iron", Metallurgical and Materials Transactions A, 36 (2005) 977-988.

Bubenko et al.; "Fatigue Crack Propagation through Austempered Ductile Iron Microstructure"; Materials Engineering, vol. 17, 2010, No. 3, p. 15-20.

Bubenko et al.; "Fatigue Crack Propagation Within the Austempered Ductile Iron Microstructure"; Acta Metallurgica Slovaca, vol. 17, 2011, No. 1, p. 18-25.

Dundar, Sacit; "Application of Austempered Ductile Iron to Rail Wheel Sets"; Journal of Engineering Sciences 2003, 9 (3), p. 283-287.

International ADI and Simulation Conference; May 28-30, 1997.

Knuckles, Types E and F—Fatigue Test, AAR Manual of Standards and Recommended Practices Castings, 2009, [M-216] 1-2.

Keough J. R., et al.; "Continuing Developments in the Science and Application of Austempered Ductile Iron (ADI)"; 2012.

AAR Manual of Standards and Recommended Practices Casting Details; Castings, Steel; Specification M-201; S [M-201] 41-S [M-201] 49.

AAR Manual of Standards and Recommended Practices Casting Details; S [M-211]143-S [M-211] 149.

AAR Manual of Standards and Recommended Practices Casting Details; Coupling Systems; Specification M-215; S [M-215] 337-S [M-215] 342.

* cited by examiner

LIGHTWEIGHT COUPLER

BACKGROUND OF THE INVENTION

1. Field of the Invention

This invention relates in general to railcars and, more particularly, to a railcar coupler, system and method.

2. Brief Description of the Related Art

Railcar couplers are disposed at each end of a railway car to enable joining one end of such railway car to an adjacently disposed end of another railway car. The engageable portions of each of these couplers is known in the railway art as a knuckle. For example, railway freight car coupler knuckles are taught in U.S. Pat. Nos. 4,024,958; 4,206,849; 4,605,133; and 5,582,307.

Typically, adjacent railway cars are joined by heavy shafts extending from each car, known as couplers, and, generally, each coupler is engaged with a yoke housing a shock-absorbing element referred to as the draft gear. The type-E coupler is the standard coupler for railway freight cars. The type-E coupler has standard specifications such that producers making a type-E coupler adhere to a standard specification, so that the standard railway car couplers are completely interchangeable, regardless of the manufacturer. In addition, adherence to a standard also enables couplers from any one manufacturer to be able to be readily joined to couplers from any other domestic manufacturer. The Association of American Railroads ("AAR") has adopted standards for railway couplers. The coupler must include specific geometry and dimensions that allow it to receive a knuckle, and the geometry must be such that the knuckle is allowed to freely operate when coupling and uncoupling railway cars. These dimensions and features of the coupler may be checked for compliance with AAR standards by using gauges, which are applied to the coupler to verify the coupler dimensions or parameters are within an allowable variation or tolerance range.

Couplers have a particular life, and in instances may fail. In many cases when a railcar coupler fails, a replacement coupler must be carried from the locomotive at least some of the length of the train, which may be up to 25, 50 or even 100 railroad cars in length. The repair of a failed coupler can be labor intensive, can sometimes take place in very inclement weather and can cause train delays.

A need exists for a coupler that is lighter in weight with similar, or improved, strength or fatigue life as prior heavier weight couplers.

SUMMARY OF THE INVENTION

The present invention provides a railcar coupler system and method that substantially eliminates or reduces at least some of the disadvantages and problems associated with previous systems and methods.

In accordance with a particular embodiment, a railcar coupler includes a coupler head portion extending from a shank portion. The coupler head portion is configured to couple to a first coupler knuckle for coupling the railcar coupler to a second railcar coupler of an adjacent railcar. The coupler head portion comprises a nose portion and a gathering face extending from the nose portion for engaging a second coupler knuckle coupled to the second railcar coupler. The coupler head portion comprises a guard arm portion extending from the nose portion.

According to some preferred embodiments, the guard atm portion is cast with the head or head portion. According to alternate embodiments, the guard arm portion may be coupled to the coupler head portion after casting the coupler head portion. According to another alternate embodiment, the guard arm portion may be cast with no internal cavities.

In accordance with another embodiment, a method for manufacturing a railcar coupler includes casting a coupler head portion extending from a shank portion. The coupler head portion is configured to couple to a first coupler knuckle for coupling the railcar coupler to a second railcar coupler of an adjacent railcar. The coupler head portion includes a nose portion and a gathering face extending from the nose portion for engaging a second coupler knuckle coupled to the second railcar coupler. According to one embodiment of the method, the method includes casting the guard arm portion as part of the head or head portion. According to another embodiment, the method includes casting a guard arm portion separate from the head portion and coupling the guard arm portion to the coupler head portion such that the guard arm portion extends from the nose portion towards the shank portion. Casting a guard arm portion may comprise casting a guard arm portion with or without internal cavities.

According to a preferred embodiment, a lightweight coupler is provided which is constructed from a material that is stronger than grade E cast steel. Is a further object to accomplish the above objects by providing a coupler that is constructed from a material that is at least as strong, or even stronger, than grade E cast steel but which is lighter in weight than grade E cast steel.

It is another object of the invention to accomplish the above objects by providing a coupler with an interior and/or exterior geometry that has one or more of coring and ribs, or combinations thereof so maximum wall thickness is preferably less than about 1.6" and more preferably less than about 1.15" and that also is constructed from a material that is lighter and of similar, or greater, strength than grade E cast steel.

It is an object of the invention to provide a coupler that is constructed from an austempered ductile metal. In a preferred embodiment, the austempered metal is austempered ductile iron (ADI). In another preferred embodiment the austempered metal is austempered steel, such as austempered alloy steel, and, according to other embodiments the coupler may be constructed from an austempered metal alloy.

Austempered ductile iron (ADI) is produced by a suitable austempering process. For example, austempering of ductile iron may be accomplished by heat-treating cast ductile iron to which specific amounts of nickel, molybdenum, manganese or copper, or combinations thereof have been added to improve hardenability; the quantities of the elements needed to produce the ADI from ductile iron are related to the coupler configurations and, for example, may depend on the thickest cross-sectional area of the coupler. Austempered steel and other austempered metals and austempered metal alloys, may be produced by any suitable austempering process.

According to one embodiment, it is another object of the invention to provide an improved lightweight coupler that is of lighter weight than existing current couplers, but without additional coring or modifications to the interior coupler geometry, by constructing a coupler from an ADI having a specific gravity of about 0.26 lbs/in^3, which is less than that of grade E cast steel, 0.283 lbs/in^3. According to one embodiment, a casting of the same shape will be lighter and stronger when constructed from ADI versus grade E cast steel. According to a preferred embodiment, there is a weight reduction of about 8% using the ADI as the preferred material for the coupler versus using grade E cast steel.

Another benefit of the present invention is to provide a coupler and process for producing a coupler that provides economic benefits of conservation of materials, without sacrificing strength. For example, the utilization of a preferred ADI material improves handling efficiencies (as iron is easier to pour than steel), and improves material usage, as the ADI material increases in volume, slightly, as the metal knuckle casting cools compared to steel which shrinks. Accordingly, embodiments of the present invention provide a more efficient use of the materials, meaning less metal may be used to make the same final shape (for a coupler having substantially the same or greater strength as if a greater amount of metal were used), as a way of reducing the coupler weight.

In another preferred embodiment, the austempered metal is austempered steel. Austempered steel is produced by a suitable austempering process. For example, austempering of steel may be accomplished by heat-treating cast steel to which specific amounts of chromium, magnesium, manganese, nickel, molybdenum, or copper, or combinations thereof have been added to improve hardenability; the quantities of the elements needed to produce the austempered steel from the cast alloy steel are related to the knuckle configurations and, for example, may depend on the thickest cross-sectional area of the coupler.

According to another embodiment, a lighter weight coupler is constructed by selectively coring out material in thick load bearing areas to provide an alternate interior and/or exterior geometry for the coupler so maximum wall thickness is preferably less than about 1.0" and more preferably less than about 0.65".

According to preferred embodiments, the coupler may be reduced in thickness in a given zone or area, such as a wall, or a guard arm portion, and the strength to weight ratio may remain the same as or greater than prior couplers having thicker walls, and even being heavier in weight. Preferably wall thickness is less than about 1.0" and more preferably less than about 0.65". The present coupler also may improve payload to weight ratios, as a lightweight coupler may allow for more weight to be cargo or other payload, especially where a locomotive is pulling a great number of cars that have lightweight couplers.

According to some preferred embodiments, the weight reduction may be made at the back, shank end section of the coupler, and may be accomplished with coring, such as, for example, exterior coring. Embodiments may be produced with reduced weight by providing exterior coring on the side and back sections of the shank.

According to embodiments, the coupler may have one or more zones of coring and ribs, or apertures, bores and/or divots, where the coupler has areas or walls of a maximum cross-sectional thickness and other areas that are less than the maximum cross-sectional thickness.

The arrangement of coring, ribs and wall thickness, may be provided to produce a coupler that is lighter in weight, but possesses sufficient strength, including meeting or exceeding railroad standards, such as AAR standards for couplers. In addition, the coupler embodiments may be produced from an austempered metal, such as, for example, austempered ductile iron, which is lighter in weight than grade E cast steel, but provides equal or greater strength, to provide a lightweight coupler that is constructed from ADI and has an arrangement of ribs and/or coring.

According to another embodiment, a coupler is provided having one or more zones of residual compressive stresses. According to one embodiment, a zone, or zones, of residual compressive stresses may be created on the entire inside and outside surface of any of the above embodiments of the lightweight coupler, while according to alternate embodiments, zones of residual compressive stresses may be created only in areas that show high tensile stress when the part is used, or combinations thereof in the areas that show high tensile stresses. For example, according to a preferred embodiment, a coupler is provided with zones of residual compressive stresses in the main areas that exhibit high tensile stress during use, which preferably include the front face or throat area, the guide or guard arm and the shank hole. According to one embodiment, a preferred method for creating residual compressive stresses is by shot peening. Shot peening involves impacting the surface with small spherical media projected at high speeds at the desired surfaces. According to embodiments of the invention, an engineered surface is provided, such as, for example, by subjecting the surface to a treatment process, such as, for example, shot peening, in order to provide the coupler with an improved ability to counteract tensile stresses that are applied during use that may otherwise tend to cause crack initiation. The provisioning of the residual compressive stresses on the coupler, such as, for example, using the shot peening procedure to impart impacts on the surfaces of the coupler at one or more desired locations, increases fatigue life and performance without the need to increase the overall strength of materials or of the part.

The lightweight couplers according to the invention may be used with standard knuckles or lightweight knuckles, including, such as, for example, the lightweight knuckles disclosed in our co-pending U.S. patent application Ser. No. 13/678,021 filed on Nov. 15, 2012 for a lightweight fatigue resistant knuckle, the contents of which are herein incorporated by reference.

Other technical advantages will be readily apparent to one skilled in the art from the following figures, descriptions and claims. Moreover, while specific advantages have been enumerated above, various embodiments may include all, some or none of the enumerated advantages.

BRIEF DESCRIPTION OF THE DRAWINGS

For a more complete understanding of the present invention and its advantages, reference is now made to the following description, taken in conjunction with the accompanying drawings, in which.

DETAILED DESCRIPTION OF THE INVENTION

The present invention provides an improved coupler which has improved strength and fatigue life. One way in which embodiments of the invention accomplish this is by providing coring that may include interior coring, external coring, or both. Another way in which embodiments of the invention accomplish this is by providing a material that is stronger than the grade E cast steel currently used. A further way in which embodiments of the invention accomplish this is by utilizing a material to construct the coupler that is stronger and lighter than the grade E cast steel currently used, while other embodiments provide a lightweight coupler by providing a unique geometry and using a material that is lighter than the current cast steel and/or stronger than the current cast steel. The embodiments also may include ribs provided for strengthening areas or zones of the coupler, which, according to preferred embodiments, may be done in conjunction with coring.

Figure 1:
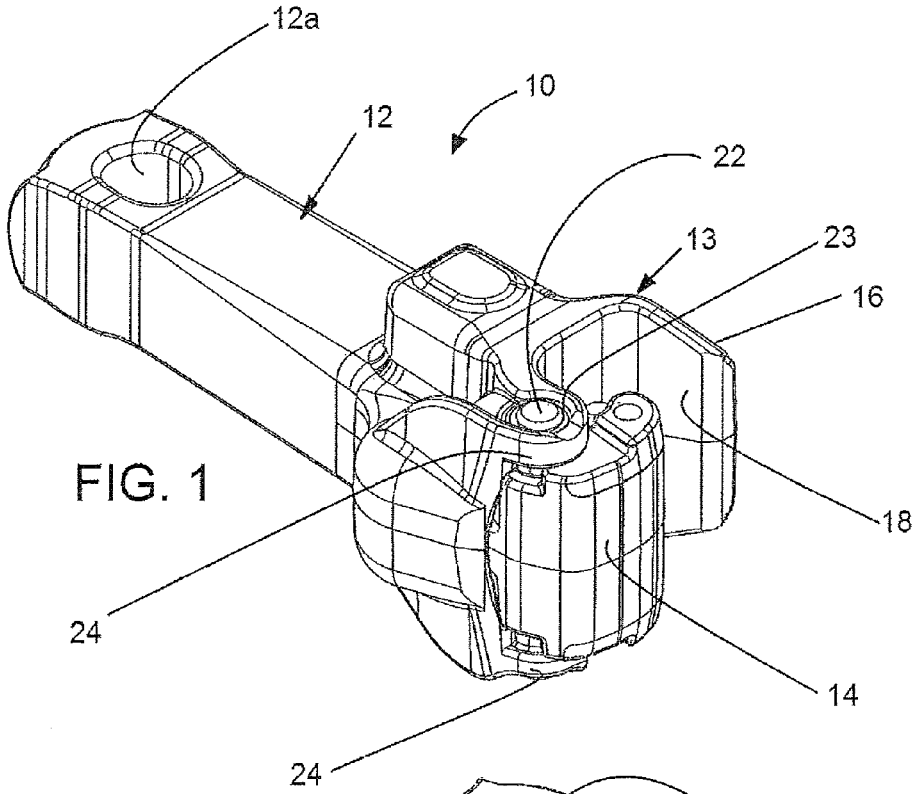
FIG. 1 is an isometric view of a railcar coupler according to the present invention.
Figure 2:
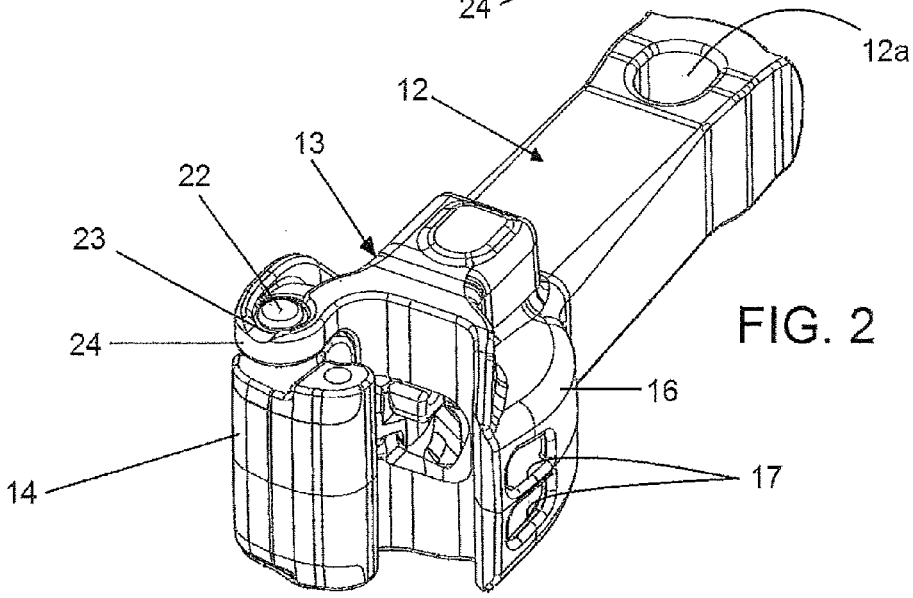
FIG. 2 is another isometric view of the railcar coupler of FIG. 1, as viewed from the right side.
Figure 3:
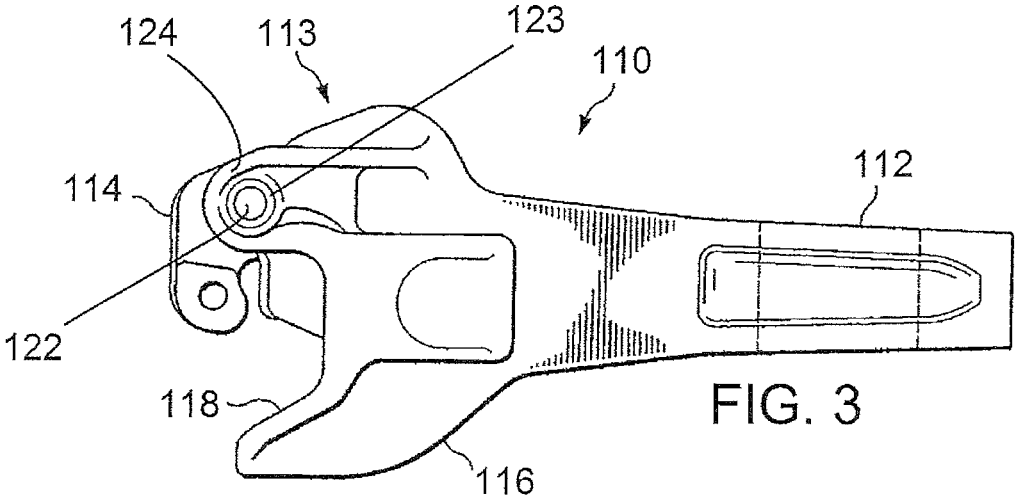
FIG. 3 is a top plan view of an alternate embodiment of a railcar coupler according to the present invention.
Figure 4:
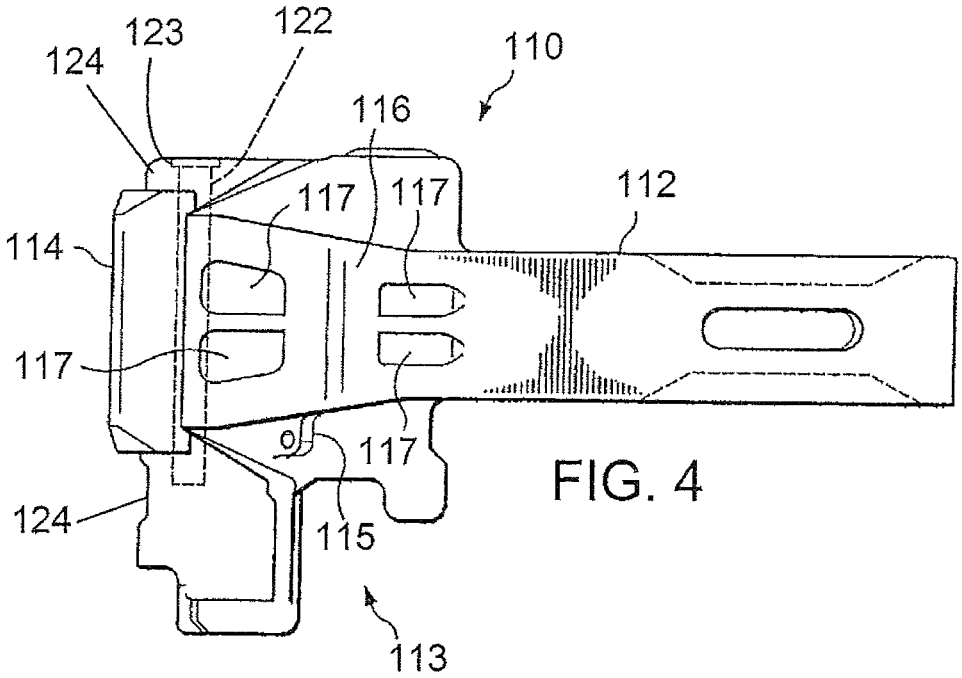
FIG. 4 is a right side elevation view of the railcar coupler of FIG. 3.
Figure 5:
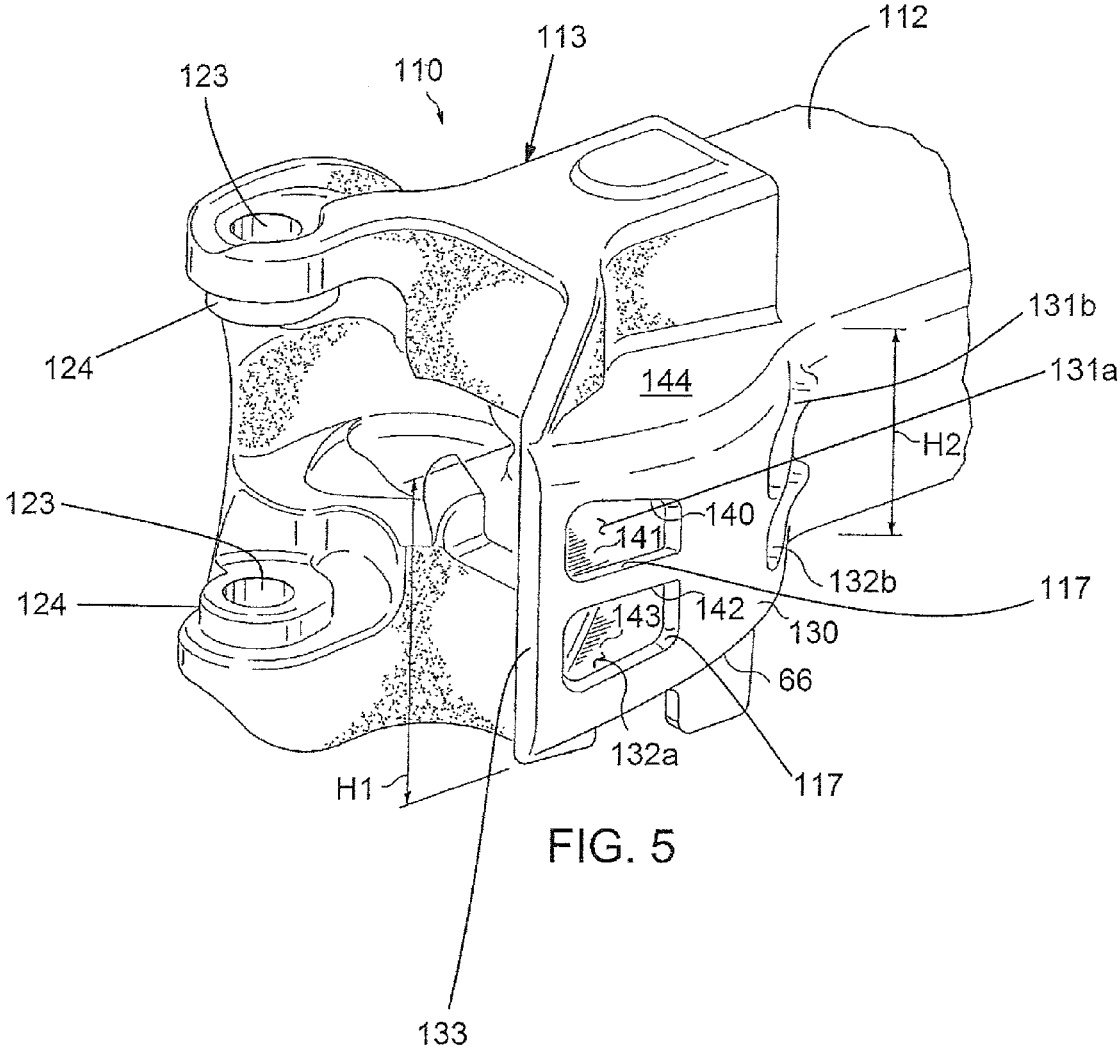
FIG. 5 is an isometric view of the railcar coupler of FIG. 3.

According to the embodiments illustrated, the coupler 10 shown in FIGS. 1-2, and the coupler 110 shown in FIGS. 3-5, may be constructed having a suitable wall thicknesses to provide the coupler with suitable strength to withstand force loads that the coupler encounters during operations, including when in use on a railway vehicle. The coupler, also referred to as a railway vehicle coupler, may be configured as a casting that includes a coupler housing and a shank which is adapted to be mounted in a draft gear (not shown) on the end of a center sill of a railway vehicle. The coupler carries a pivotally connected knuckle that is movable between open and closed positions. According to preferred embodiments, the coupler shank and housing casting, as well as the knuckle casting, may be made from an austempered metal, and preferably austempered steel, such as, austempered alloy steel. Other austempered metals, such as, for example, austempered ductile iron, and austempered metal alloys, may be used to construct the coupler.

According to a preferred embodiment, the unique geometry includes providing one or more zones of reduced material, which, for example, according to one embodiment, may be accomplished by coring, and preferably, with specialized coring in designated zones of the coupler, which, for example, may be provided in the housing, the shank, the knuckle component, or any one or more or all of these. Embodiments of the coupler also may include ribs provided for strengthening areas or zones of the coupler, which, according to preferred embodiments, may be done in conjunction with coring. The ribs may be provided in configurations alternate to those shown and described herein. Although embodiments of the present lightweight coupler may be constructed to resemble prior coupler geometries, including prior exterior coupler geometries, lightweight couplers according to the invention may be constructed to have geometries that are different than prior couplers, but which also are compatible with coupling and usage of the prior couplers, so that the current coupler may provide a lightweight coupler alternative that may be used in place of prior couplers, wherever the prior couplers have been used or are called for.

According to preferred embodiments of the invention, a coupler configuration is provided having areas of the coupler that are reduced relative to other areas of the coupler (which may be areas and other areas within the same coupler component, e.g., the housing, shank and knuckle. The preferred geometries of the coupler provide zones of size or weight reductions or both size and weight reduction, and where the size or weight reductions, or both, are employed to maximize the strength of the coupler. According to a preferred embodiment, a coupler is provided with reduced areas of size or weight, or, in some instance's, elimination of structure in certain areas to provide a suitably strong coupler that is able to withstand the stresses required for performance under operating loads.

According to a preferred embodiment, a lightweight coupler may be substantially the same in appearance on the exterior to prior coupler exterior appearances, yet the lightweight coupler may have a unique coring which is designed to provide adequate strength yet eliminate extraneous material. For example, the operative contour of the coupler that is exhibited on the coupler exterior, such as, for example, the engaging surfaces, may have an appearance similar to prior couplers, but unlike prior couplers, be configured with a different interior construction, where the interior geometry of the coupler is configured and arranged in a manner that provides suitable performance strength with a reduced construction weight.

FIGS. 1 and 2 illustrate a coupler 10 for freight railway cars in accordance with standard specifications as set forth by the Mechanical Committee of Standard Coupler Manufacturers. Coupler 10 is mounted within a yoke (not shown) secured at each end of a railway car center sill, such that, in accordance with a preferred mounting arrangement, the coupler 10 may extend outwardly under an end of a railway car to engage a similar coupler (or any compatibly connectible coupler) extending outwardly under an end of an adjacent railway car. Coupler 10 includes a shank 12 having a bore 12*a* which is adapted to connect to the yoke (not shown) on the end of a center sill of a railway vehicle. The generally V-shaped coupler head 13 is provided at a forward end extending from the shank 12. Shank 12 is adapted to be fitted within and attached to a yoke secured at each end of a center sill extending full length under the railway car at a longitudinal axis.

Coupler head 13 has a vertical-knuckle 14 rotatably pinned at an outer end of coupler head 13 forming a first leg of coupler head 13, while a second leg of coupler head 13 comprises a fixed and rigid guard arm portion 16 with cavities 17. Coupler 10 also includes a first angled gathering surface 18 (FIG. 1) against which a vertical-knuckle 14 on a mating coupler similar to coupler 10 is intended to impact when two adjacent railway cars are brought together. When vertical knuckle 14 impacts against an angled gathering face 18 of another coupler, it and the opposing vertical knuckle 14 are each pivoted inwardly to a degree sufficient to lock them in place behind each other so that the couplers 10 are properly joined together. A lock member slidably disposed within each coupler head 13 may be activated by the engagement to slide downwardly within the coupler head 13 and lock the vertical knuckle 14 in place to thereby join the two railway cars together. Coupler 10 is illustrated additionally including a chain lug (not shown) which preferably is provided at the lower portion of the head 13.

To assure a successful coupling, the two railway cars preferably may be sitting on a straight length of track, and the two couplers, like coupler 10, may be at least generally oriented parallel to the track and perpendicular to the end of the railway car to face each other. In some cases, couplers may include features such as extended guard arm portions, as illustrated in U.S. Pat. No. 6,148,733, that facilitate railway car coupling when the railway cars are sitting on a length of curved track or are otherwise not aligned with each other.

FIG. 3 is a top plan view of a coupler 110 with a shank 112, a head 113, a knuckle 114, a first angles gathering surface 118, a fixed guard arm portion 116. As best shown in FIG. 4, cavities 117 are illustrated provided in the arm 116 and a chain lug 115 also is shown. The chain lug 115 may be used to support hoses (such as air line hoses) and other components when the coupler 10 is not operational or otherwise not connected. Chain lugs in some couplers may be located on a coupler lock chamber. A knuckle pin 122 which is installed in pivot pin openings 123 (only one being illustrated) of pivot lugs 124 retains the knuckle 114 on the head 113. As illustrated in FIG. 5, a preferred configuration of the head 113 of the coupler 110 is illustrated to show an exemplary embodiment where the pivot lugs 124 are aligned with the respective pivot openings 123. The exemplary coupler 110 may be configured having a guard arm portion 130 with cavities 131*a*, 132*a* and 131*b*, 132*b*. The cavities may be defined by interior sidewalls 140, 141, 142, 143. An exterior sidewall 144 is also shown in FIG. 5. The guard arm portion 130 extends from the shank 112 to the nose portion 133 of coupler 110. According to some embodiments, the construction is provided so that the slope and configuration of the guard arm portion 130 provide strength and stability to the coupler 110, and in particular the portion of the coupler 110 extending between the nose portion 133 and the shank 112.

In accordance with prior couplers, cavities 131*a*, 132*a* and 131*b*, 132*b*, have been provided to reduce weight. However, the cavities, while reducing weight, have led to problems in strength. According to a preferred embodiment, the present invention provides a casting of the coupler 110, and more particularly, of the coupler head 113 and shank 112 with an austempered metal to produce a stronger and more fatigue-resistant coupler 110. According to a preferred embodiment, the austempered metal is austempered steel, and according to another embodiment the austempered metal is austempered ductile iron. The austempered ductile iron embodiment provides suitable strength, yet may provide a coupler that is significantly lighter, for example, up to 8% in weight lighter, than couplers that are constructed from cast grade E steel. According to one embodiment, it is another object of the invention to provide an improved fatigue-resistant coupler that is of lighter weight than existing current couplers, but without additional coring or modifications to the interior geometry, by constructing a coupler from an austempered ductile iron (ADI) having a specific gravity of about 0.26 lbs/in^3, which is less than that of grade E cast steel, 0.283 lbs/in^3. According to one embodiment, a casting of the same shape will be lighter and stronger when constructed from ADI versus grade E cast steel. According to a preferred embodiment, there is a weight reduction of about 8% using the ADI as the preferred material for the coupler versus using grade E cast steel.

Coupler 110 having guard arm portion 116, according to a preferred embodiment, may be manufactured through a casting process with a metal, such as ductile iron (DI), steel or alloys of either or other metal alloys and then austempered after casting. Typically one or more cores may be used in the manufacturing process in order to form cavities 131*a*, 131*b*, 132*a*, 132*b*. The cores typically may be made of resin or otherwise hardened sand. Specifically, the coupler 110 may be produced in a mold cavity within a casting box between cope and drag sections. Sand, such as green sand, may be used to define the interior boundary walls of the mold cavity. The mold cavity may be formed using a pattern and may include a gating system for allowing molten metal, which preferably is austempered metal, to enter the mold cavity. The mold cavity defines the exterior surfaces of coupler 110, including the exterior surface of guard arm portion 116. The cores used to form cavities 131*a*, 131*b*, 132*a*, 132*b* are placed at an appropriate location within the mold cavity. Once the coupler 110 is cast, the sand or resin cores may be removed leaving cavities 131*a*, 131*b*, 132*a*, 132*b*. Accordingly, embodiments where cavities other than those illustrated in FIGS. 3-5 are present may be formed in a similar manner, through the use of the aforementioned casting and gating systems. Coupler 110 may undergo a metal finishing process that includes finishing the interior surfaces of cavities 131*a*, 131*b*, 132*a*, 132*b*, including the interior sidewalls 140, 141, 142, 143. Alternatively the casting can be made as an investment casting to ensure tighter tolerances.

Moreover, while particular embodiments are illustrated herein as Type E couplers, other embodiments may include similar features and configurations in other types of couplers, such as Type F or H couplers.

According to an alternate embodiment, the couplers may be cast without the guard arm portions. This may be done a number of ways, including, for example, using a typical casting process with a metal (such as, for example, ductile iron (DI), steel, alloy ductile iron, or alloy steel) and austempered after casting. The head 113 may therefore be cast as a head portion without the guard arm portion 116, and accordingly, the guard arm portion 116 may be coupled to the head portion after casting the coupler head portion. According to some embodiments, the guard arm portion 116 may be cast with internal cavities, and according to other embodiments, the guard arm portion 116 may be cast with no internal cavities. Preferably, the guard arm portion 116 is cast using a typical casting process with a metal (such as, for example, alloyed ductile iron (DI) or alloy steel) and austempered after casting. For example, as discussed above with respect to coupler 110, the coupler head portion may be produced in a mold cavity within a casting box between cope and drag sections. Sand may be used to define the interior boundary walls of the mold cavity. The mold cavity may be formed using a pattern and may include a gating system for allowing molten alloy to enter the mold cavity. The mold cavity defines the exterior surfaces of coupler head portion. Since, as indicated above, the head portion of the coupler 110, according to an alternate casting embodiment, is cast without guard arm portion 116, the mold cavity may have a different configuration than a mold cavity used to produce the coupler 110 when the coupler is produced with the head 113 including the head portion and the guard arm portion 116. For example, the mold cavity used to produce the coupler head portion, where the guard arm portion 116 is separately provided, will not include a cavity section defining guard arm portion 116. According to alternate embodiments where a guard arm portion 116 is not produced with the casting of the head 113, then after the guard arm portion 116 has been produced, it is attached to the head portion that was independently formed without a guard arm portion. Attachment of a guard arm portion to a head portion may be accomplished using any suitable method, such as by welding the guard arm portion to the head portion, bolting, or other fastening mechanism.

According to the alternate embodiments, where the guard arm portion 116 is provided separate from the head portion, the guard arm portion 116 may be independently produced using any suitable method, such as, for example, a casting process similar to that used to produce coupler 10 and 110 (where the guide arm portion 116 is cast with the head 113). In this case, where the guard arm portion 116 is provided as a separate component to the coupler, a mold cavity may be designed to define the outer surfaces of guard arm portion 116. Although guard arm portions are shown and described herein, the guard arm portions, according to alternate embodiments not illustrated, may include shapes and/or configurations different from those guard arm portions 16, 116, and thus mold cavities used to form other guard arm portions may be different from a mold cavity used to form guard arm portions 16, 116. Alternatively the casting can be made as an investment casting to ensure tighter tolerances.

According to some embodiments, the chain lug 115 may be formed through the core process used in the coupler manufacturing process. According to alternate embodiments, while not shown, the chain lug 115 may be cast without its hole, and then the hole may be located using a drill, punch or other method. This permits specific placement of the chain lug hole.

According to alternate embodiments, the chain lug may comprise a hole positioned on the guard arm portion, or alternately, the chain lug may be coupled to the guard arm portion. Preferably, the chain lug may be positioned so it is located near the head of the coupler to provide a good location for support of the hoses and other components (since they may be more fully extended when supported at the chain lug than if the chain lug were positioned further back on the coupler).

Figure 6:
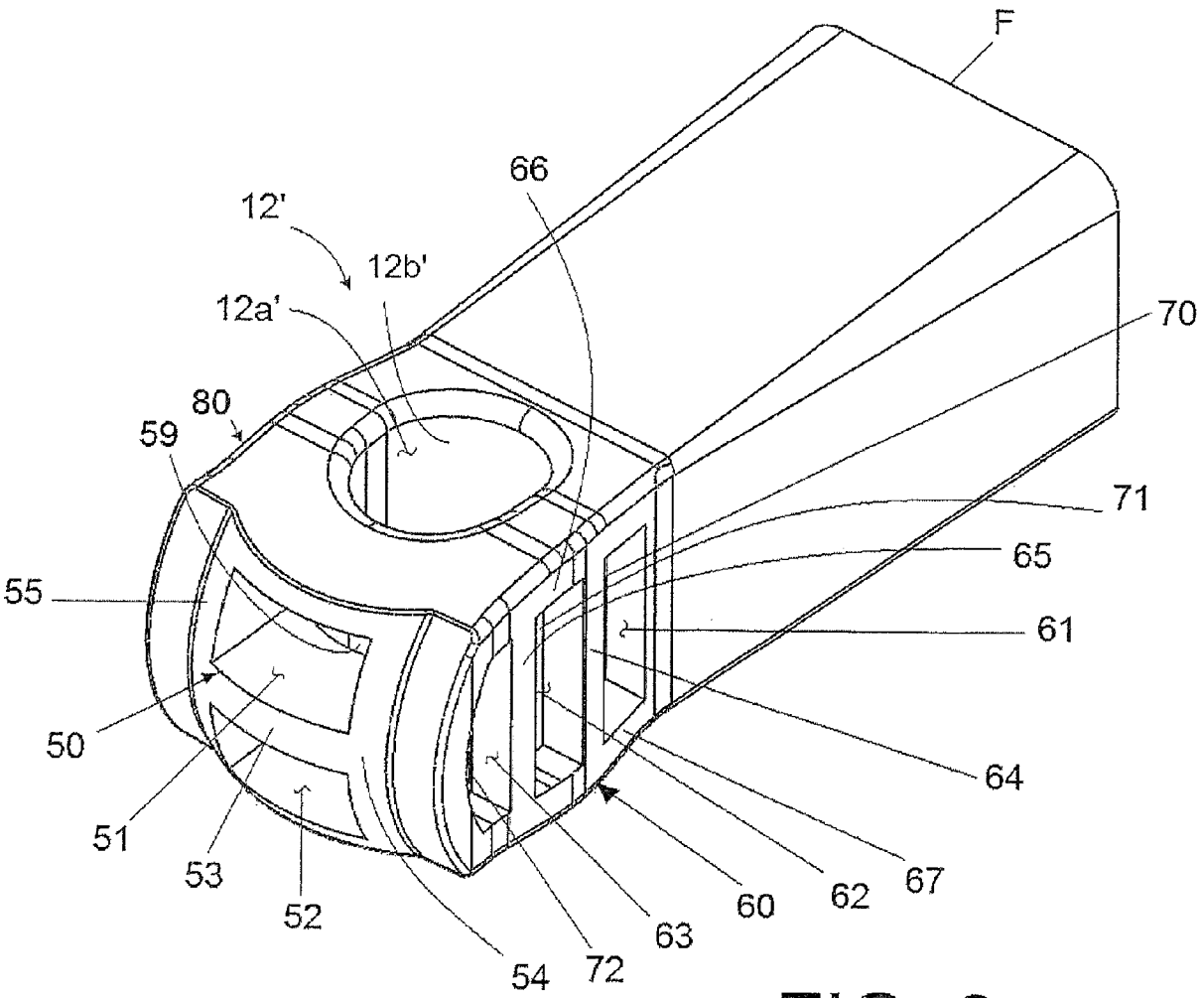
FIG. 6 is an isometric view of an alternate embodiment of a coupler rear section in accordance with the invention, which may be used in the construction of a coupler, including, for example, any of the couplers shown and described herein.

Referring to FIG. 6, an isometric view of a rear section 12' of a coupler is shown in accordance with an alternate embodiment of the invention. The rear section 12' configuration may be applied and used in the construction of couplers, including those couplers shown and described herein. The coupler rear section 12' shows the shank portion of a coupler, the head of which (although not shown in FIG. 6) would be located at the front end denoted by the reference F. The coupler rear section 12' has a bore 12*a*' which is adapted to connect to the yoke (not shown) on the end of a center sill of a railway vehicle. The bore 12*a*' preferably is defined by a wall 12*b*'. According to preferred embodiments, the wall 12*b*' may span from the top of the bore 12*a*' to the bottom of the bore 12*a*', and preferably, the bore 12*a*' extends entirely through the coupler section 12'. A coupler head (not shown in FIG. 6) is provided at the front end F of the coupler rear section 12' to complete the coupler (and a coupler knuckle may be installed on the head). A rear weight reduction zone 50 is provided on the rear of the coupler rear section 12', and, according to a preferred embodiment, is illustrated with coring comprising a first core 51 a second core 52 and a rib 53 spanning between a first side wall 54 and a second side wall 55. The rear weight reduction zone first core 51 and second core 52 may terminate at an inner wall, such as, for example, the inner wall 59 shown at the inner end of the first core 51. The inner wall 59 of the first core 51 may be coextensive with the bore wall 12*b*', and, according to preferred embodiments, inner wall 59 may be the exterior surface of the bore wall 12*b*'. Similarly, although not shown, the second core 52 may have an inner wall that may be coextensive with the bore wall 12*b*', and, according to preferred embodiments, the second core inner wall may be the exterior surface of the bore wall 12*b*'.

The coupler rear section 12' and couplers formed therewith, preferably have a plurality of weight reduction zones. According to a preferred embodiment, a first side weight reduction zone 60 is provided on one side of the coupler rear section 12', and preferably, a second side weight reduction zone 80 (not shown in detail) is provided on the opposite side of the coupler rear section 12'. According to a preferred embodiment, the first side weight reduction zone 60 includes coring. In a preferred arrangement, coring is illustrated comprising a first side core 61, a second side core 62 and a third side core 63. Ribs 64 and 65 are spaced apart to define the side cores, 61, 62, 63, and span between an upper wall portion 66 and a lower wall portion 67. Preferably, side cores, 61, 62, 63, have a depth relative to the outer surface of the coupler rear section 12' that is defined by upstanding side walls, respectively 70, 71, 72. The upstanding side walls 70, 71, 72, according to preferred embodiments, may be formed coextensive with the bore wall 12*b*'. For example, according to a preferred embodiment, the bore wall 12*b*' may have a first side that defines in whole or part the bore 12*a*' and a second side that defines the upstanding side walls 70, 71, 72, and, preferably, the second side may also define the inner wall 59. The rib 53 spanning between the first side wall 54 and a second side wall 55 of the rear weight reduction zone 50 may be joined with the bore wall 12*b*' (e.g., at the inner wall 59).

A second side weight reduction zone 80 (not shown in detail) preferably is provided and may be configured on the side of the coupler rear section 12' that is opposite the side at which the first side weight reduction zone 60 is provided. The second side weight reduction zone 80 preferably has ribs and coring configured in the same manner as the ribs and coring shown and described in connection with the first side weight reduction zone 60.

The coupler rear section 12' may be constructed having a suitable wall thicknesses to provide the coupler section 12' and coupler constructed with the section 12' with suitable strength to withstand force loads that are encountered during operations, including when in use on a railway vehicle. The coupler section 12' and couplers constructed incorporating the section 12' may be configured as a casting. Although the coupler rear section 12' is described and illustrated, a coupler may be constructed having the rear section 12', and preferably is configured with a head portion with suitable connecting means at the front F of the coupler rear section 12', for coupling the coupler to a railcar coupler of an adjacent railcar. The connecting means may comprise a coupler knuckle carried on the front or head portion of the coupler. Preferably, the coupler knuckle carried at the front F of the rear section 12', such as on a head portion connected to the front F of the rear section 12', is configured to couple to a railcar coupler of an adjacent railcar. The coupler including the configuration of the rear section 12' preferably is lighter in weight, yet suitably strong to meet or exceed the AAR standards for railcar couplers.

According to some preferred embodiments, the coupler rear section 12' may be constructed having maximum wall thicknesses of preferably less than about 1.6" and, more preferably less than about 1.15" if ADI is used and preferably less than about 1.0" and, more preferably less than about 0.65" if austempered steel is used.

Furthermore, further strengthening of the couplers shown and described herein may be accomplished by providing shot peened surfaces. For example, one or more of the inner surfaces and outer surfaces of the coupler, including the surfaces that define the cavities 131*a*, 131*b*, 132*a*, 132*b*, may be provided with a shot-peened surface. The shot peened surface treatment, for example, may be applied to one or more of the guard arm 16 (FIG. 1), 116 and the gathering surface 18 (FIG. 1), 118. The shot-peened surfaces may include inner surfaces and outer surfaces of the knuckle, and may further include the surfaces of ribs when ribs are present and used in an embodiment. A shot-peened surface treatment preferably is applied to the surfaces to provide added strength. The shot-peened surface treatment may be applied by any number of ways, including, for example, by impacting the surface with shot (e.g., round metallic, glass, or ceramic particles) with force sufficient to create plastic deformation. In addition, the embodiment of the coupler rear portion 12' illustrated in FIG. 6 also may be provided with a shot-peened surface treatment along one or more of its surfaces.

In addition, although cavities 131*a*, 131*b*, 132*a*, 132*b* are shown and described in connection with the guard arm portion 116, the couplers according to the invention, including couplers such as the couplers 10, 110, may have cavities in other locations of the coupler, including, for example, the head and shank. In addition, a knuckle may be provided having cavities. According to a preferred embodiment, the coupler 10, 110, and couplers formed with the coupler rear section 12', may be configured with and include a knuckle constructed according to our copending U.S. application Ser. No. 13/678,021, including, for example, lightweight, fatigue resistant knuckles shown and described therein.

As indicated above, particular embodiments discussed herein include couplers having different configurations, including having guard arm portions of various shapes, sizes and configurations and having various configurations where the chain lugs may be positioned in various places on the coupler. Embodiments of the present invention may combine one or more of the various guard arm portion casting or attachment methods and chain lug features and/or elements discussed herein.

Although the present invention has been described in detail with reference to particular embodiments, it should be understood that various other changes, substitutions, and alterations may be made hereto without departing from the spirit and scope of the present invention. The present invention contemplates great flexibility in the manufacturing process of couplers and coupler knuckles and the shape, configuration and arrangement of one or more internal or external cores used in the manufacturing process.

A significant benefit of the present invention is that current proven coupler design and the composition of forming the coupler (including one or more of the coupler components, such as, the knuckle and coupler and guide arm portion when case separately from the head portion) from an austempered metal, provides a coupler that is stronger and more fatigue-resistant. In addition, the coupler may be constructed using additional coring to provide a coupler that is lighter, but also is stronger and also has improved resistance to fatigue (including when compared with other couplers weighing substantially the same as, or greater than, prior couplers). According to some embodiments, the couplers of the present invention may be constructed from austempered metal to significantly improve the strength. In addition, due to the increased strength of the material, such as, for example, when the coupler is constructed from austempered metal (e.g., such as, for example, austempered ductile iron), coring configurations (including those shown and described herein, as well as alternate coring arrangements) may be used to provide a coupler that may be lighter in weight than prior couplers and which also possesses increased resistance to fatigue (including in comparison to prior couplers that are heavier in weight). The exemplary embodiments shown and described herein illustrate examples of preferred coring for a coupler having improved strength and resistance to fatigue, as well as a coupler that is lighter in weight than traditional prior couplers. Other coupler embodiments disclosed herein provide a coupler configuration that is similar to prior coupler configurations, but is constructed from an austempered metal (preferably austempered steel or austempered ductile iron) to provide an improved strength to weight ratio as well as improved elongation properties. Still other embodiments provide both coring and rib configurations to reduce mass, and compose the coupler from an austempered metal (preferably austempered steel or austempered ductile iron), to improve or maintain the strength of the coupler (e.g., a strength to weight ratio).

According to preferred embodiments of the invention, lightweight couplers may be constructed from grade E stainless steel, such as for example, couplers configured with the coupler rear section 12' where one or more weight reduction zones are provided to reduce the weight of the coupler. According to other preferred embodiments, lightweight couplers, including the couplers 10, 110, and, including, in addition thereto, couplers configured with a construction of weight reduction zones as disclosed in connection with the coupler rear section 12', are constructed from an austempered metal, preferably austempered steel, austempered ductile iron, austempered steel alloy or austempered ductile iron alloy. Preferred compositions, such as steel, as well as alloy steel compositions, e.g., alloyed preferably with magnesium, manganese, molybdenum, copper or mixtures thereof, or more preferably, with chromium, nickel or mixtures thereof, (or mixtures of the preferred and more preferred metals), may be used to fond the couplers as discussed and shown herein. The steel or preferred/more preferred alloy steel composition is austempered to obtain tensile strength, yield, and elongation properties for the inventive couplers which are suitable to meet or exceed the AAR standards for couplers, including the current standard set forth by the American Association of Railroads (AAR) in AAR Manual of Standards and Recommended Practices, such as current standard M-211, M-205, M-220 NDT and Rule 88 of the AAR Office Manual, the complete contents of which are herein incorporated by reference. Couplers may be constructed from ductile iron that is austempered. The ductile iron also may be used in alloy form, preferably, with nickel, molybdenum, manganese, copper, or mixtures thereof, to form couplers.

The couplers may be constructed in accordance with a suitable forming method, such as, for example, a casting method, used to produce a coupler that meets or exceeds the AAR coupler standards.

Lightweight couplers may be produced using the improved coupler configurations disclosed and shown herein. In addition, lightweight couplers are constructed from austempered ductile iron, austempered ductile iron alloy, austempered steel, and/or austempered steel alloy, in accordance with the invention, to provide couplers that are lighter in weight than prior couplers yet possesses suitable strength, yield and fatigue resistant properties that meet or exceed AAR testing and standards requirements set forth by the American Association of Railroads (AAR) in AAR Manual of Standards and Recommended Practices, and in Rules of the AAR Office Manual, the compete contents of which are herein incorporated by reference.

It is intended that the foregoing detailed description be regarded as illustrative rather than limiting, and that it be understood that it is the following claims, including all equivalents, that are intended to define the spirit and scope of this invention. Numerous other changes, substitutions, variations, alterations and modifications may be ascertained by those skilled in the art and it is intended that the present invention encompass all such changes, substitutions, variations, alterations and modifications as falling within the spirit and scope of the appended claims.

What is claimed is:

1. A railway vehicle coupler, comprising:

(a) a shank portion;

(b) a coupler head portion extending from said shank portion; and (c) connecting means for connecting the coupler to a coupler of an adjacent railcar;

(d) wherein the coupler shank portion has a front end, a back end, and a weight reduction zone provided at the back end thereof;

(e) including a bore disposed at the back end thereof, said bore being defined by a wall portion, (f) wherein said wall portion has a thickness;

(g) wherein said weight reduction zone has a core; and (h) wherein said wall portion has a first surface on one side of said thickness that defines said bore;

(i) wherein said wall portion has a second surface on the other side of said thickness defining said core of said weight reduction zone;

(j) wherein said weight reduction zone comprises a rear weight reduction zone provided at the back end of said coupler shank portion, and wherein said coupler has a first side weight reduction zone provided on one side of said coupler shank portion and a second side weight reduction zone provided on the other side of said coupler shank portion; and (k) wherein said first side weight reduction zone has at least one core with an inner wall, wherein said second side weight reduction zone has at least one core with an inner wall, and wherein said bore defining wall portion second surface defines said first side core inner wall and said second side inner wall.

2. The railway vehicle coupler of claim 1, wherein said coupler is constructed from austempered metal.

3. The railway vehicle coupler of claim 2, wherein said austempered metal is austempered alloy steel.

4. The railway vehicle coupler of claim 3, wherein said austempered steel comprises steel alloyed with one or more metals selected from the group consisting of chromium, nickel, magnesium, manganese, copper, molybdenum, and mixtures thereof, wherein said steel alloyed with said one or more metals is austempered to produce said vehicle coupler.

5. The railway vehicle coupler of claim 2, wherein the austempered metal is austempered steel.

6. The railway vehicle coupler of claim 2, wherein said austempered metal is austempered ductile iron.

7. The railway vehicle coupler of claim 6, wherein said austempered ductile iron comprises ductile iron alloyed with one or more metals selected from the group consisting of nickel, molybdenum, manganese, copper and mixtures thereof, wherein said ductile iron alloyed with said one or more said metals is austempered to produce said vehicle coupler.

8. The railway vehicle coupler of claim 1, wherein said coupler has internal or external ribs.

9. The railway vehicle coupler of claim 1, wherein the coupler head portion is configured to couple to a first coupler knuckle for coupling the railcar coupler to a second railcar coupler of an adjacent railcar;

the coupler head portion comprising a nose portion and a gathering face extending from the nose portion for engaging a second coupler knuckle coupled to the second railcar coupler; and the coupler head portion comprising a guard arm portion extending from the nose portion towards the shank portion.

10. The railway vehicle coupler of claim 9, wherein said coupler has inside surfaces and outside surfaces.

11. The railway vehicle coupler of claim 10, wherein said at least one or more of the coupler inside surfaces and outside surfaces is a shot-peened surface.

12. The railway vehicle coupler of claim 1, including a guard arm portion.

13. The railway vehicle coupler of claim 12, wherein said guard arm portion is integrally provided with said head portion.

14. The railway vehicle coupler of claim 13, wherein said coupler comprises a first casting including said shank portion, said head portion and said guard arm portion.

15. The railway vehicle coupler of claim 12, wherein said guard arm portion is provided as a separate component attached to said head portion.

16. The railway vehicle coupler of claim 12, wherein said coupler comprises a first casting including said shank portion and said head portion.

17. The railway vehicle coupler of claim 1, further comprising a knuckle pivotally carried on the head portion.

18. The railway vehicle coupler of claim 17, wherein said knuckle is constructed from austempered metal.

19. The railway vehicle coupler of claim 18, wherein said knuckle is constructed from austempered ductile iron.

20. The railway vehicle coupler of claim 18, wherein said knuckle is constructed from austempered alloy steel.

21. The railway vehicle coupler of claim 17, wherein said coupler comprises a first casting including said shank portion, said head portion and a second casting comprising said knuckle.

22. The railway vehicle coupler of claim 1, wherein said coupler back end includes a rear portion with an outer surface, wherein said first side weight reduction zone has a plurality of side cores including said at least one side core, wherein spaced apart ribs define said plurality of side cores, wherein said coupler includes an upper wall portion and a lower wall portion, wherein said ribs span between said upper wall portion and said lower wall portion, wherein said plurality of side cores each has a depth relative to the outer surface of the coupler rear portion that is defined by an upstanding wall, and wherein each defining upstanding wall is coextensive with said bore defining wall portion.

23. The railway vehicle coupler of claim 22, wherein said second side weight reduction zone is configured having a plurality of side cores including said at least one side core, wherein spaced apart ribs define said plurality of side cores of said second side weight reduction zone, wherein said coupler includes an upper wall portion and a lower wall portion of said second side weight reduction zone, wherein said ribs of said second side weight reduction zone span between said upper wall portion and said lower wall portion of said second side weight reduction zone, wherein said plurality of side cores of said second side weight reduction zone each has a depth relative to the outer surface of the coupler rear section that is defined by an upstanding wall of said second side weight reduction zone, and wherein each defining upstanding wall of said second side weight reduction zone is coextensive with said bore defining wall portion.

24. The railway vehicle coupler of claim 1, wherein said connecting means for connecting the coupler to a coupler of an adjacent railcar comprises a coupler knuckle.

25. A railway knuckle coupler comprising:

(a) a shank portion;

(b) a coupler head portion extending from said shank portion, (c) the coupler head portion configured to couple to a first coupler knuckle for coupling the railcar coupler to a second railcar coupler of an adjacent railcar;

(d) the coupler head portion comprising a nose portion and a gathering face extending from the nose portion for engaging a second coupler knuckle coupled to the second railcar coupler;

(e) the coupler head portion comprising a guard arm portion extending from the nose portion towards the shank portion;

(f) a coupler knuckle;

(g) a pair of pivot lugs disposed on said head portion;

(h) a pivot pin disposed in said pivot lugs and pivotally mounting said knuckle on said head portion;

(i) wherein said coupler shank portion and head portion are constructed from austempered metal selected from the group consisting of austempered ductile iron and austempered steel;

(j) a guard arm portion, (k) a plurality of cavities, (j) wherein at least some of said plurality of cavities are provided in said guard arm portion;

(l) wherein said coupler has inside surfaces and outside surfaces, (m) wherein at least some of said inside surfaces define said cavities;

(n) wherein said coupler is constructed from at least one first casting that includes said coupler shank portion and coupler head portion;

(o) wherein said coupler knuckle is constructed from at least one second casting;

(p) wherein said at least one or more of the coupler inside surfaces and outside surfaces is a shot-peened surface.

26. The railway knuckle coupler of claim 25, wherein said inside surfaces and said outside surfaces define coupler walls having a thickness, and wherein said maximum thickness of said coupler walls is 1.6 inches.

27. The railway knuckle coupler of claim 1, having walls, and wherein the walls have thicknesses substantially less that those walls of AAR standard couplers.

28. The railway knuckle coupler of claim 1, having walls, and wherein the walls have a maximum thickness of 1.6 inches.

29. The railway knuckle coupler of claim 1, wherein the walls have a maximum thickness of 1.15 inches.

30. The railway knuckle coupler of claim 1, wherein the walls have a maximum thickness of 1.0 inches.

31. The railway knuckle coupler of claim 1, wherein the walls have a maximum thickness of 0.65 inches.

32. The railway knuckle coupler of claim 25, wherein said austempered ductile iron comprises ductile iron alloyed with one or more metals selected from the group consisting of nickel, molybdenum, manganese, copper and mixtures thereof, wherein said ductile iron alloyed with said one or more said metals is austempered to produce said vehicle coupler.

* * * * *